United States Patent [19]

Aleff

[11] 4,382,520

[45] May 10, 1983

[54] FLOW CONTROL STRUCTURES

[75] Inventor: Hans P. Aleff, Cumberland, R.I.

[73] Assignee: Cia. Vinicola del Vergel, S.A., Gomez Palacio, Mexico

[21] Appl. No.: 218,539

[22] Filed: Dec. 22, 1980

[51] Int. Cl.[3] ..... B65D 49/02

[52] U.S. Cl. ..... 215/21; 222/567

[58] Field of Search ..... 222/454–457, 222/477, 481, 562, 564, 567, 188; 215/17, 21, 26, 28, 22

[56] References Cited

U.S. PATENT DOCUMENTS 1,750,591 3/1930 Hafermann ..... 215/21

3,794,202 2/1974 Unger ..... 215/22

FOREIGN PATENT DOCUMENTS 464384 6/1951 Italy ..... 222/454

*Primary Examiner*—H. Grant Skaggs

*Attorney, Agent, or Firm*—Edward D. O'Brian; K. H. Boswell

[57] ABSTRACT

A flow control structure such as is commonly referred to as a non-refillable closure which is primarily useful in minimizing the possibility of a bottle being refilled can be constructed so as to utilize two oppositely connected air traps in a passage which preferably also contains a ball-type check valve. The structure is intended to be mounted on the neck of a bottle so that in effect the passage serves as the bottle opening. When the bottle is in its normal upright position both one of the air traps and the check valve serve to prevent liquid from flowing into the interior of the container. When the bottle is in an inverted position in which at least part of the interior of the bottle is above the structure, the check valve is open as a result of the action of gravity and the air traps permit liquid to flow out of the bottle and air to flow into the container, but one of the air traps prevents liquid from flowing into the interior of the bottle.

6 Claims, 6 Drawing Figures

FLOW CONTROL STRUCTURES

BACKGROUND OF THE INVENTION

The invention set forth in this specification pertains to new and improved flow control structures such as are commonly referred to as non-refillable closures.

The flow control structures of the present invention are primarily intended to be utilized in connection with various types of bottles so as to prevent unscrupulous individuals from replacing the original contents of such bottles. These flow control structures are primarily utilized in packaging various comparatively valuable ethanolic beverages so as to prevent the bottles used with such beverages from being refilled after their initial contents have been removed. These flow control structures are, however, capable of being utilized in preventing the replacement or the adulteration of various other different types of containers. As manufactured the flow control structures of the type to which this invention pertains normally include or are used with a conventional closure element or cap.

In the past many different flow control structures of the type indicated in the preceding discussion have been developed and many of such structures have been widely used. It is not considered that an understanding of the present invention requires a detailed discussion of such prior related structures. In general, it is considered that various prior flow control structures in the field of the present invention have been comparatively disadvantageous for any one or more of several different reasons. Certain of such structures have been comparatively complex and difficult to make and, hence, undesirably expensive. Certain of such prior flow control structures are considered to unnecessarily impede the pouring of a liquid from a bottle. Many of such prior flow control structures are considered unsatisfactory because of the fact that some individuals have learned to refill bottles or similar containers equipped with them.

BRIEF SUMMARY OF THE INVENTION

As a result of considerations as indicated in the preceding paragraph it is believed that there exists a need for new and improved flow control structures such as are commonly referred to as non-refillable closures. Broadly the present invention is intended to provide new and improved flow control structures meeting this need. The invention set forth in this specification is also intended to provide flow control structures: which may be easily and conveniently manufactured at a comparatively nominal cost; which may be easily and conveniently installed on bottles or similar containers; which do not significantly interfere with the flow of a fluid from a container; and which are of such a character that containers equipped with these flow control structures are extremely difficult or effectively impossible to refill without these structures being damaged. Obviously the presence of such damage will always indicate visually that there is a strong probability that a container has been refilled with other than the liquid originally packaged within the container.

In accordance with this invention these various objectives of the invention are achieved by providing a flow control structure for use in controlling the direction of liquid flow through an opening located at the top of a container so as to permit flow from the interior of said container when said container is in an inverted position in which at least part of the interior of said container is above said opening and so as to prevent liquid flow into the interior of said container, said structure having an upper and a lower end and an internal passage leading between its ends, said structure also including a holding means for holding said structure with respect to said container so that all flow through said opening is through said internal passage in which the improvement comprises: said passage being shaped so as to include two connected, oppositely facing air traps, said traps being oriented with respect to one another and with respect to the remainder of said structure so that when said structure is secured to said container by said holding means and said container is in said inverted position concurrently air can flow into said container and liquid can flow out of said container through said passage but liquid cannot flow into said container because of air trapped within a first of said traps and so that when said container is in an upright position liquid cannot flow into the interior of said container because of air trapped within the second of said traps.

BRIEF DESCRIPTION OF THE DRAWINGS

Because of the nature of this invention it is considered that it is best more fully explained with reference to the accompanying drawings in which.

Figure 1:
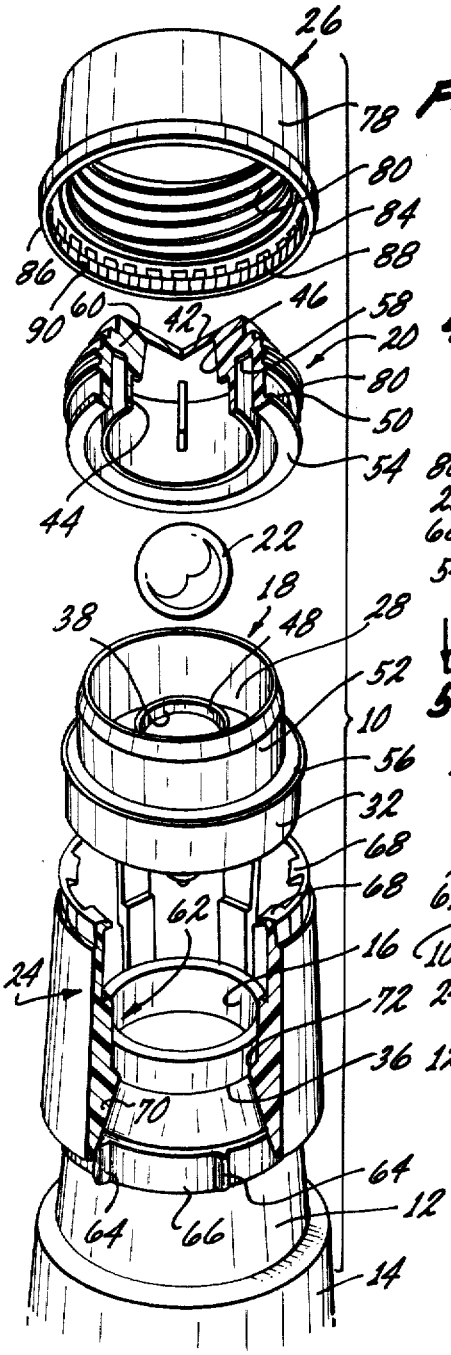
FIG. 1 is an exploded view in which various parts are shown in isometric projection of a complete flow control structure or non-refillable closure in accordance with this invention.

The flow control structure illustrated in FIGS. 1 to 5 of the drawings is considered to be a presently preferred embodiment or form of a flow control structure in accordance with this invention. However, it must be realized that the basic principles or features of the present invention set forth and defined in the appended claims can be utilized within a wide variety of differently appearing and somewhat differently constructed flow control structures or non-refillable closures through the use or exercise of routine engineering skill. For this reason the present invention is not to be considered as being limited to the precise structures illustrated, but is to be considered as encompassing any structure falling within the scope of the appended claims.

DETAILED DESCRIPTION

In the drawing there is shown a flow control structure or non-refillable closure 10 of the present invention which is adapted to be utilized on the neck 12 of a bottle 14 so as to close off the opening 16 into the bottle 14.

This flow control structure 10 is constructed so as to include various different separately manufactured parts which are indicated in FIG. 1. These parts include an internal fitment 18 for use in closing off the opening 16 as hereinafter described, a pouring cap 20 normally located against and above the fitment 18, a ball 22 forming a part of a check valve structure (not separately numbered) created by the cap 20 being located on the fitment 18, a holding tube or sleeve 24 serving as a holding means as hereinafter described and a cover 26 serving as a conventional closure in connection with the remainder of the flow control structure 10.

All of these parts of the flow control structure 10 may be conveniently and easily manufactured through the use of conventional injection molding techniques at a comparatively nominal cost from a material having self-supporting, resilient characteristics enabling various parts formed of this material to undergo temporary deformation. As will be subsequently apparent, it is quite important to the assembly of the structure that the holding tube or sleeve 24 be formed of material having such characteristics. If desired, other parts may be formed of a more rigid material.

The fitment 18 is constructed so as to include an upwardly facing imperforate annular channel 28 having a generally U-shaped cross-sectional configuration. Dependent from this channel 28 is a conventional cylindrical plug 30 which is adapted to fit within the interior of the neck 12 as shown so as to form a seal against it. Also dependent from the channel 28 is an annular hold-down collar or skirt 32 having an internal annular flange 34 which is adapted to closely engage an external bead 36 extending around the neck 12 immediately adjacent to the opening 16.

The interior wall 38 of the channel 28 and the plug 30 in effect are use so as to define an elongated tube (not separately numbered) which extends through the fitment 18 from within the neck 12 of the bottle 14 to generally above this neck 12. If desired, a series of sloping internal vanes 40 may be formed on the plug 30 so as to be located within the neck 12 as shown. These vanes 40 extend radially with respect to the axis (not shown) of the plug 30 and are used to facilitate molding of the fitment 18.

Figure 2:
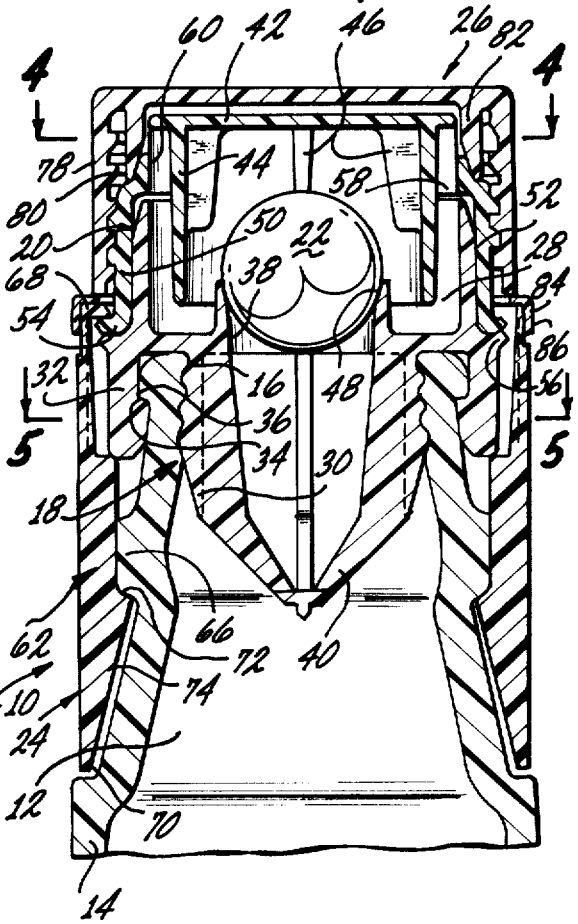
FIG. 2 is a cross-sectional view of this flow control structure installed on the neck of a bottle as it would appear after being utilized in packaging a liquid within the bottle.

The pouring cap 20 is constructed so as to include an imperforate top 42 which carries a dependent imperforate annular wall 44. This wall 44 is located around and spaced from the interior wall 38 of the channel 28 and extends a short distance into this channel 28 as shown in FIG. 2. Preferably a series of comparatively short radially extending ribs or vanes 46 are located within the wall 44. The ball 22 is located generally between the ribs 46 in a position in which it can move relative to a beveled surface 48 on the wall 38 serving as a valve seat. This ball 22 is capable of fitting against this valve seat 48 so as to form a seal therewith during the use of the complete flow control structure 10. It is, of course, capable of moving between the ribs 46 away from this valve seat 48. These ribs 46 in effect act as guides for movement of the ball 22.

The pouring cap 20 also includes an annular skirt 50 which is concentric with the wall 44 and which is dimensioned so as to fit closely against an exterior wall 52 of the channel 28. Preferably this skirt 50 includes a bottom flange 54 which rests against a corresponding spacing flange 56 on the fitment 18 immediately beneath the wall 52. The skirt 50 is connected to the top 42 through the use of a series of vertically extending, spaced ribs or posts 60. Because of the way that this skirt 50 serves to position the cap 20 it can be considered as a positioning means for positioning the cap 20 in an operative position on the fitment 18. All of these posts 60 are spaced from the wall 44 so that the spaces (not separately numbered) between the posts 60 can serve as discharge openings. Although only one of such openings is required for the structure 10 to be operative, it is preferred to utilize a series of such openings as shown extending completely around the wall 44 so that the bottle 14 can be held in any desired manner in an inverted position during the use of the structure 10 in pouring out the contents of this bottle 14.

The holding tube or sleeve 24 employed is provided with a series of internally extending, somewhat ratchet-like engagement flanges 62 which are adapted to engage small lugs 64 on an annular ring 66 on the neck 12 of the bottle 14 when the structure 10 is assembled on this bottle 14 as subsequently indicated. The holding tube 24 also includes a series of internally extending top flanges 68 which are dimensioned so as to be capable of overlying the bottom flange 54 on the skirt 50 so as to hold the pouring cap 20 against the fitment 18 in order to prevent removal of these parts from the neck 12. These flanges 68 are alternated around the interior of the holding tube 24 as shown so as to be equally spaced from one another and so that the holding tube 24 can be manufactured by injection molding techniques utilizing comparatively simple dies.

With this type of construction the flanges 62 are of course also equally spaced from one another. These flanges 62 include abutting surfaces 70 which fit closely against the ring 66 so as to center the holding tube 24 on the neck 12. They also fit alongside of the lugs 64. The holding tube 24 is held by these flanges 62 in a position in which the lugs 64 are located generally between the flanges 62.

With this type of construction it is extremely difficult if not impossible to remove the holding tube 24 from the neck 12 of the bottle 14 without causing visible damage to the holding tube 24. Because the holding tube 24 is formed of a material as noted capable of limited temporary deformation and is constructed with sloping surfaces 74 on the flanges 62 leading to the ledges 72 it can be pressed down upon the neck 12 during the assembly of the structure 10 so as to be "snapped" or "popped" into place.

The cover 26 used with the flow control structure 10 is essentially in the nature of a common lid or cover including an imperforate top 76 adapted to overlie the pouring cap 20 and a conventional dependent skirt 78 adapted to fit around the skirt 50 of the pouring cap 20. Cooperating attachment means 80 such as common threads are preferably formed on the interior of the skirt 78 and the exterior of the skirt 50 so that the cover 26 can be repeatedly removed from and relocated upon the pouring cap 20 during the use of the structure 10. It is considered preferable to include within this cover 26 a conventional dependent sealing flange 82 which is adapted to fit against the support wall 58 as illustrated for the purpose of forming a seal when the cover 26 is located in its normal non-use position.

Although it is not necessary with the present invention it is considered preferable to construct the cover 26 so that it will be evident to the initial user of a bottle 14 closed using a flow control structure 10 of the present invention as to whether or not this cover has been opened prior to such user acquiring the bottle 14. This can conveniently be accomplished by locating around the lower edge (not separately numbered) of the skirt 78 a small, outwardly projecting, easily severable flange 84. If desired, this flange 84 can be perforated so as to facilitate its being broken. This flange 84 supports an annular ring 86 having internal ratchet-like teeth 88. When the structure 10 is to be utilized with this flange 84 and this ring 86, the exterior of the holding tube 24 is formed with corresponding ratchet-like teeth 90 which will co-act with the teeth 88 in a conventional manner so as to hold the ring 86 against movement as the cover 26 is twisted so as to remove this cover 26 from the pouring cap 20.

Figure 3:
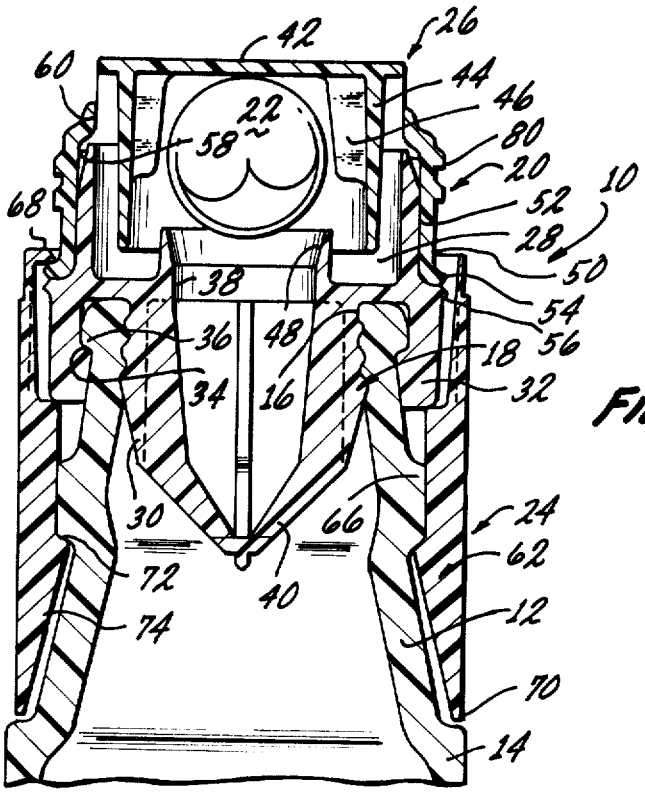
FIG. 3 is a partial cross-sectional view corresponding to FIG. 2 showing the flow control structure and the bottle in an inverted position such as is used for pouring with the cover forming a part of this structure as initially supplied by the manufacturer removed from it.
Figure 4:
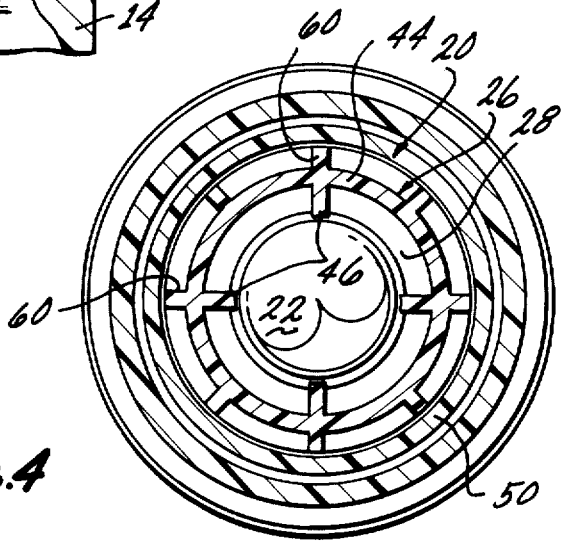
FIG. 4 is a cross-sectional view taken at line 4—4 of FIG. 2.
Figure 5:
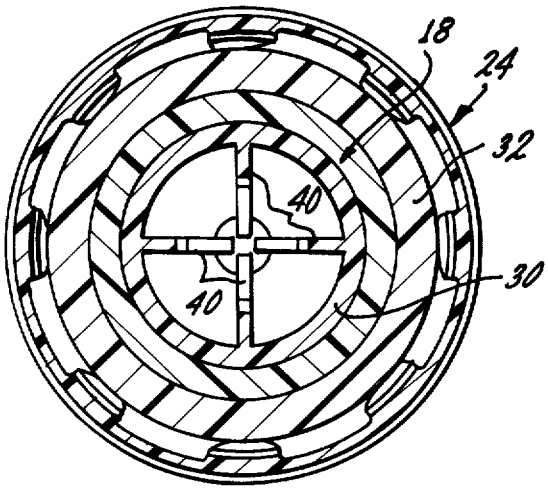
FIG. 5 is a cross-sectional view taken at line 5—5 of FIG. 2.

The use of the flow control structure 10 is essentially very simple. During the packaging of a bottle 14 the various parts of the structure 10 as preassembled are located above the neck 12 and are then pushed down in place on the neck 12. When it is desired to remove the liquid from within the bottle 14 the cover 26 is removed and the bottle 14 is inverted to a position as indicated in FIG. 3 in which at least part of the interior of the bottle 14 is above the flow control structure 10.

As this occurs, gravity will move the ball 22 from the seat 48 so as to permit liquid to flow through the fitment 18 and then through the space (not separately numbered) between this fitment 18 and the pouring cap 20 and thence out through one or more of the spaces between the posts 60 serving as discharge openings. As liquid flows in this manner air will flow into the bottle 14 above the liquid flowing out in substantially the reverse of the route taken by the liquid.

The importance of the flow control structure 10 lies in the relative effective impossibility of re-introducing a liquid into the bottle 14 after the contents of the bottle have been exhausted in this manner. Because of the locations of the spaces (not separately numbered) between the posts 60 it is substantially impossible for an individual to insert any implement into the structure 10 so as to facilitate re-introduction of a liquid into the bottle 14.

If the bottle 14 is held in an upright position beneath the surface of a liquid after the bottle 14 has been partially or completely emptied, air will be trapped generally beneath the top 42 and within the wall 44 in such a manner as to prevent the flow of liquid into the interior of the bottle 14. Also, the ball 22 will seat against the seat 48 as a result of the bottle 14 being in an upright position and will serve as a double protection against flow into the interior of the bottle 14.

In any effort should be made to introduce liquid into the interior of the bottle 14 by holding this bottle in an inverted position under the surface of a liquid, the air trapped within the interior of the bottle will of course oppose liquid flow into the interior of the bottle 14. If the bottle 14 is only inverted to a limited extent in an effort to partially refill the bottle by holding it underneath the surface of a liquid, some air will be trapped within the channel 28 so as to tend to prevent liquid flow into the interior of the bottle 14.

From this it will be apparent that the structure 10 is constructed so as to utilize two air traps (not separately numbered) which are analogous to common water traps such as are utilized in many plumbing fixtures to prevent the flow of gas. The first of these traps in effect is constituted by the channel 28 and by the portion of the wall 44 fitting within this channel 28. The second of these traps is constituted by the top 42, the wall 44 and the portion of the interior wall 38 fitting within the wall 44. In effect these structures constitute two connected, oppositely facing air traps which are oriented with respect to one another and with respect to the remainder of the flow control structure 10 so as to achieve the action indicated in the preceding discussion.

Figure 6:
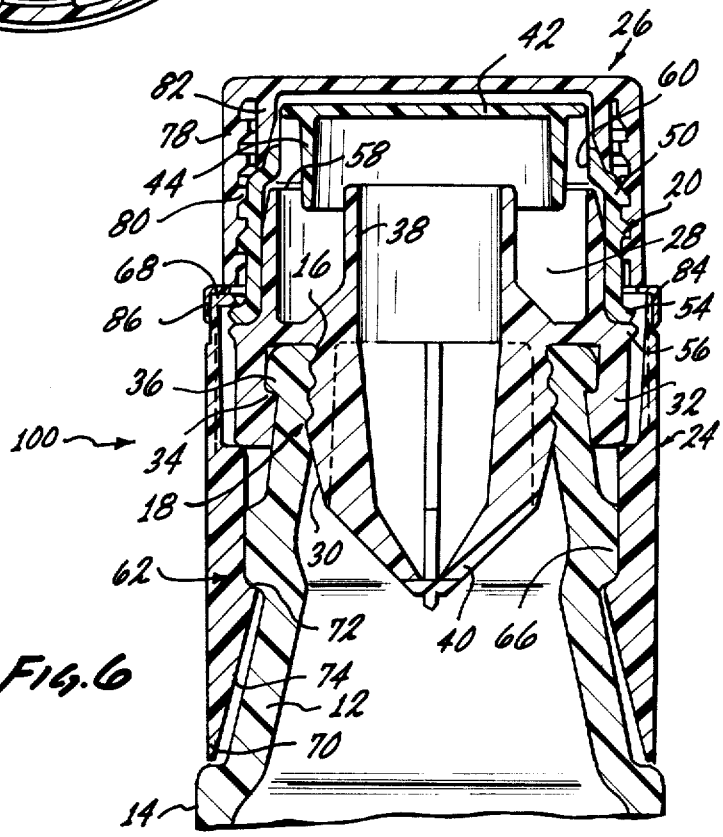
FIG. 6 is a cross-sectional view corresponding to FIG. 2 of a modified structure in accordance with this invention omitting a ball check valve as employed with the previously described structure.

The modified structure 100 illustrated in FIG. 6 of the drawings does not utilize the ball 22 described in the preceding, but in all other respects is identical to the previously described structure 10. Because of the relationship between this structure 100 and the structure 10 it is unnecessary to separately describe the separate parts of the structure 100. They are identified in FIG. 6 by the same numerals previously used to designate such parts.

This modified structure 100 has been illustrated in order to establish the point that an effective non-refillable type flow control structure can be manufactured without utilizing the parts constituting a check valve as described in the preceding discussion. Such utilization is possible because of the use of a physical structure constituting two different air traps connected as indicated in the preceding discussion. Although the structure 100 is considered to be effective for its intended purpose it is considered that it will frequently be desirable to utilize the structure 10 instead of the structure 100 because the presence of the ball 22 and the structure 10 will make it exceedingly difficult for anyone to develop a method of refilling the structure 10 without damaging the structure 10 in one manner or another.

I claim:

1. A flow control structure for use in controlling the direction of liquid flow through an opening located at the top of a container so as to permit flow from the interior of said container when said container is in an inverted position in which at least part of the interior of said container is above said opening and so as to prevent liquid flow into the interior of said container, said structure having an upper and lower end and an internal passage leading between its ends, said structure also including a holding means for holding said structure with respect to said container so that all flow through said opening is through said internal passage in which the improvement comprises:

said structure including a fitment and a pouring cap, said fitment having an exterior shaped so as to fit against the interior of said container adjacent to said opening so as to prevent flow between the exterior of said fitment and said container, said fitment including an elongated tube extending from one side to the other side of said fitment from generally adjacent to the lower end thereof toward the upper end thereof and an upwardly facing annular channel located around said tube, said annular channel being located between the ends of said tube, a pouring cap located on the upper side of said fitment adjacent to the upper end of said fitment, said pouring cap including an imperforate top, an annular imperforate wall dependent from said top and positioning means for positioning said cap on said fitment so that said annular wall fits within said annular channel in such a manner that flow through said channel past said annular wall is possible and so that said upper end of said fitment fits within said annular wall in such a manner that flow through said cap from the interior of said tube to said channel is possible, said positioning means including a plurality of discharge openings located immediately beneath said top on the exterior of said annular wall in communication with said annular channel, said openings extending completely around said top, said annular channel and the portion of said annular wall fitting within said annular channel constituting a first, upwardly directed air trap, the upper end of said tube fitting within said annular wall so as to serve as a second, downwardly directed air trap; and said holding means serving to engage said pouring cap so as to hold said pouring cap against said fitment in order to hold both said pouring cap and said fitment in place.

2. A structure as claimed in claim 1 including:

gravity operated check valve means within said passage for permitting the flow through said passage when said container is in said inverted position for preventing flow through said passage when said container is in said upright position.

3. A structure as claimed in claim 2 wherein:

said check valve means includes a ball located within the space within said annular wall adjacent to said imperforate top, said ball being movable within said space so as to be positioned away from the end of said tube within said annular wall, said ball being capable of fitting against the end of said tube adjacent to said imperforate top, said ball being capable of being moved toward and away from said end of said tube adjacent to said imperforate top so as to be capable of serving as a check valve, guide ribs for controlling the movement of said ball relative to said end of said tube adjacent to said imperforate top located on the interior of said annular wall.

4. A structure as claimed in claim 1 including:

a cover having an imperforate end and an imperforate dependent skirt, cooperating means on the interior of said skirt and on the exterior of said pouring cap for securing said cover relative to said structure so that said cover may be removed from said structure.

5. A structure as claimed in claim 4 including:

cooperating means for forming a fluid tight seal against leakage located on said cover and on said pouring cap, said cooperating sealing means being located so as to seal off said discharge openings from the exterior of said structure.

6. A structure as claimed in claim 1 including:

gravity operated check valve means within said passage for permitting the flow through said passage when said container is in said inverted position for preventing flow through said passage when said container is in said upright position, said check valve means includes a ball located within the space within said annular wall adjacent to said imperforate top, said ball being movable within said space so as to be positioned away from the end of said tube within said annular wall, said ball being capable of fitting against the end of said tube adjacent to said imperforate top, said ball being capable of being moved toward and away from said end of said tube adjacent to said imperforate top so as to be capable of serving as a check valve, guide ribs for controlling the movement of said ball relative to said end of said tube adjacent to said imperforate top located on the interior of said annular wall, a cover having an imperforate end and an imperforate dependent skirt, cooperating means on the interior of said skirt and on the exterior of said support wall for securing said cover relative to said structure so that said cover may be removed from said structure, cooperating means for forming a fluid tight seal against leakage located on said cover and on said pouring cap, said cooperating sealing means being located so as to seal off said discharge opening from the exterior of said structure.

* * * * *